US005335838A

United States Patent [19]

Harris et al.

[11] Patent Number: 5,335,838

[45] Date of Patent: Aug. 9, 1994

[54] STAPLING MACHINE

[75] Inventors: Edward M. Harris, Pontyclun, Wales; Michael Burlington, Mark Cros, England

[73] Assignee: ACCO-Rexel Group Services Plc, West Drayton, England

[21] Appl. No.: 976,342

[22] Filed: Nov. 17, 1992

[30] Foreign Application Priority Data

Nov. 19, 1991 [GB] United Kingdom ..... 9124499.6

[51] Int. Cl.[5] ..... B25C 5/11

[52] U.S. Cl. ..... 227/132; 227/134; 227/144

[58] Field of Search ..... 227/128, 127, 132, 134, 227/144, 146

[56] References Cited

U.S. PATENT DOCUMENTS

| | | | |
|---|---|---|---|
| 2,157,987 | 5/1939 | Johnson | 227/134 |
| 2,326,540 | 8/1943 | Krantz | 227/132 |
| 2,328,839 | 9/1943 | Obstfeld et al. | 227/134 |
| 2,493,640 | 1/1950 | Peterson | 227/132 |
| 2,580,505 | 1/1952 | Balma | 227/144 |
| 3,103,012 | 9/1963 | Kohen et al. | 227/127 |
| 3,758,016 | 9/1973 | Olney et al. | 227/132 |
| 4,984,729 | 1/1991 | Balma | 227/128 |

*Primary Examiner*—Scott Smith

*Attorney, Agent, or Firm*—Mason, Fenwick & Lawrence

[57] ABSTRACT

In a stapling machine, an ejector blade can be moved to eject a staple through a staple ejection slot towards an anvil adapted to clinch the ends of the arms of the staple. The staple ejector blade is moved by an actuator element. A toggle is provided which maintains the actuator element in a first position until a predetermined force has been applied to the actuator element. The toggle then releases the actuator element permitting the actuator element to move the ejector blade to eject a staple through the staple ejection slot towards the anvil.

6 Claims, 3 Drawing Sheets

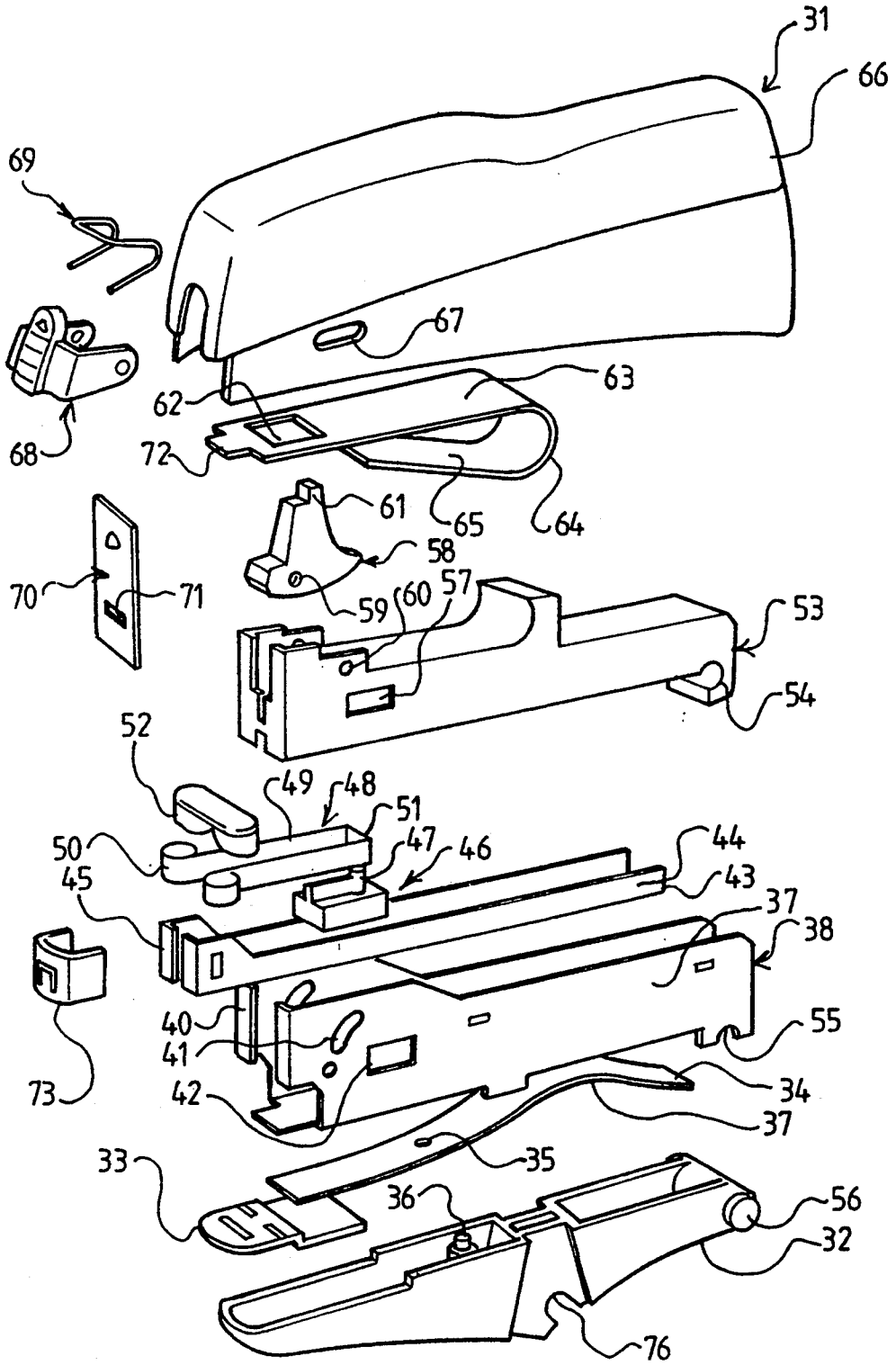
FIG. 3
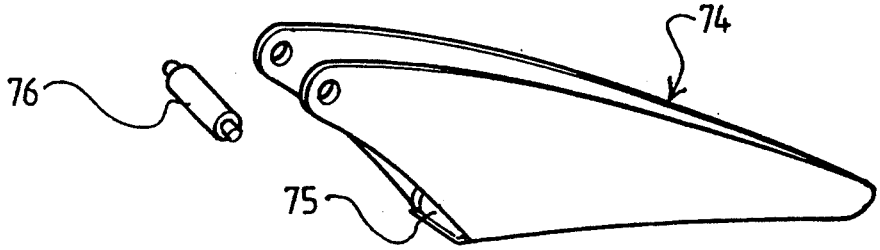

STAPLING MACHINE

THE PRESENT INVENTION relates to a stapling machine and more particularly relates to a stapling machine adapted for use in stapling items such as sheets of paper.

BACKGROUND OF THE INVENTION

A typical stapling machine for use in stapling together sheets of paper comprises two main components which are pivotally connected together. One component carries an anvil which is adapted to clinch the ends of two arms present on a staple which is ejected from the other component. The other component includes a staple magazine adapted to contain a plurality of staples, the staple magazine having one end aligned with a staple ejection slot. Means are provided to bias the staples towards the staple ejection slot. An ejector blade can be moved through the staple ejector slot to eject a staple. Typically, the ejector blade is moved either by pressing the top of the component containing the staple magazine downwardly, or by operating an actuating lever if the stapling machine is of the "pliers" type.

A disadvantage that arises is that the staple is driven down towards the anvil solely by the force applied by the person operating the device, and if that force is not sufficient to cause the staple to penetrate cleanly through any sheets of paper located between the two components, then the staple may become deformed, and the stapling operation will not be carried out satisfactorily.

SUMMARY OF THE INVENTION

The present invention seeks to provide an improved stapling machine in which the above-described disadvantage of prior proposed stapling machines is obviated or reduced.

According to this invention there is provided a stapling machine for stapling together sheets of paper or the like, the stapling machine comprising a first component carrying an anvil adapted to clinch the ends of the arms of the staple, which is pivotally connected to a second component containing a magazine for staples, means defining a staple ejection slot, means for biassing staples within the magazine towards the staple ejection slot, and a staple ejector blade adapted to move through the staple ejection slot to eject a staple towards the anvil, the staple ejector blade being associated with an actuator element adapted to move the ejector blade, the actuator element being provided with means to retain the actuator element in a first predetermined position until a predetermined force has been applied to the actuator element tending to bias the ejector blade downwardly, means being provided then to release the actuator element to permit the actuator element to move, driving the staple ejector blade.

Preferably the means adapted to retain the actuator element in position comprise a toggle having part adapted to engage part of the actuator element, the toggle being adapted to be moved to a position in which the toggle does not engage the spring when said predetermined force has been applied to the actuator element.

Conveniently the toggle is resiliently biassed towards a position in which it engages the actuator element.

Advantageously the actuating element spring is a spring of substantially "U" shape, presening two substantially parallel arms, one arm being connected to the staple ejection blade and being associated with said toggle, the other arm being movable, away from the first arm actuating element, to apply said predetermined force to the first element, means being provided to operate the toggle when the said other arm has been moved to apply said predetermined force.

Conveniently the toggle is provided with means adapted to engage the free end of the said other arm of the actuator spring when the actuator spring hass been moved to apply said predetermined force.

One embodiment of the invention may be in the form of a pliers stapling machine, the stapling machine incorporating a manually operable actuating lever which is pivotally connected to the first component and which engages said actuator spring to effect operation of the stapling machine.

Preferably the actuating lever has roller means engaging the said other arm of said actuator spring.

Advantageously said roller means also engage the first arm of said actuator spring, and the actuating handle is provided with resilient means adapted to bias the actuating handle to an initial position, so that as the handle is biassed towards the initial position the roller engages the actuating spring and moves the actuating spring to an initial position.

BRIEF DESCRIPTION OF THE DRAWINGS

In order that the invention may be more readily understood, and so that further features thereof may be appreciated, the invention will now be described, by way of example, with reference to the accompanying drawings in which FIG. 3 is an exploded view of another embodiment of the invention.

DESCRIPTION OF THE PREFERRED EMBODIMENTS

Referring to the accompanying drawings, a stapling machine 1 is illustrated which is in the form of a pliers-type stapling machine.

Figure 1:
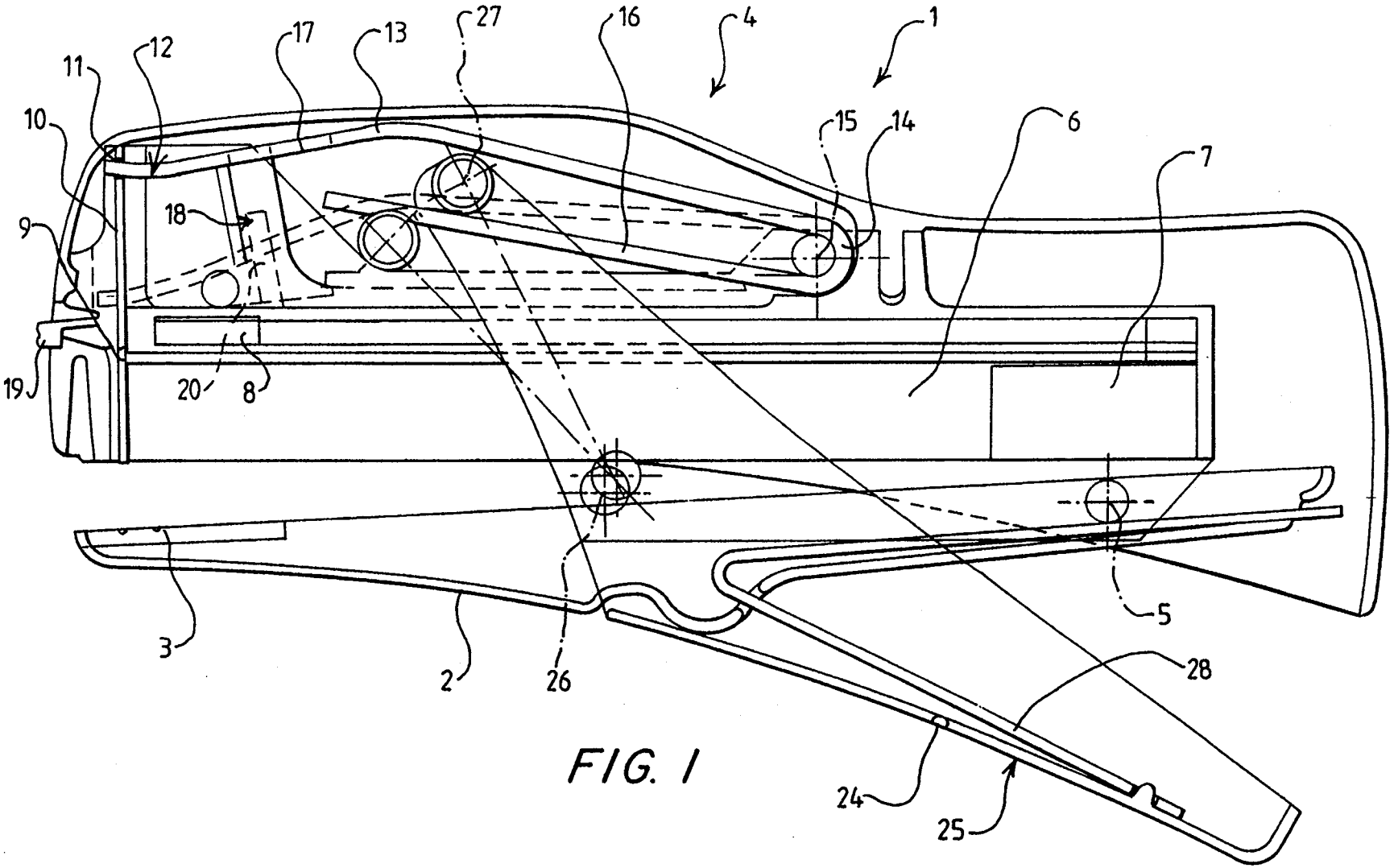
FIG. 1 is a side view of the operative parts of a stapling machine, the alternate positions of some of the parts being shown in phantom.

The stapling machine 1 incorporates a lower elongate component 2 carrying, at its forward end (i.e. to the left as shown in FIG. 1) an anvil 3 adapted to clinch the lower end of staples ejected from an upper component 4 which is pivotally connected to the lower component about a pivot point 5.

The upper component 4 comprises a hollow housing which contains an elongate staple magazine 6 adapted to receive a "strip" of staples. A slidable pusher element 7 is associated with the magazine 6 and is associated with a spring element 8 which is adapted to bias the pusher element along the staple magazine 6 to bias staples therein towards an ejection slot 9 which is provided at the forward end of the component 4 substantially in alignment with the anvil 3.

A staple ejector blade 10 is provided which is movable through the ejection slot 9 to eject a staple, from the magazine, towards the anvil 3. The ejector blade 10 is movable within an appropriate guide slot provided within the housing, and the upper end of the ejector blade 10 is provided with an aperture 11 which receives the forward end of an ejector spring element 12.

Figure 2:
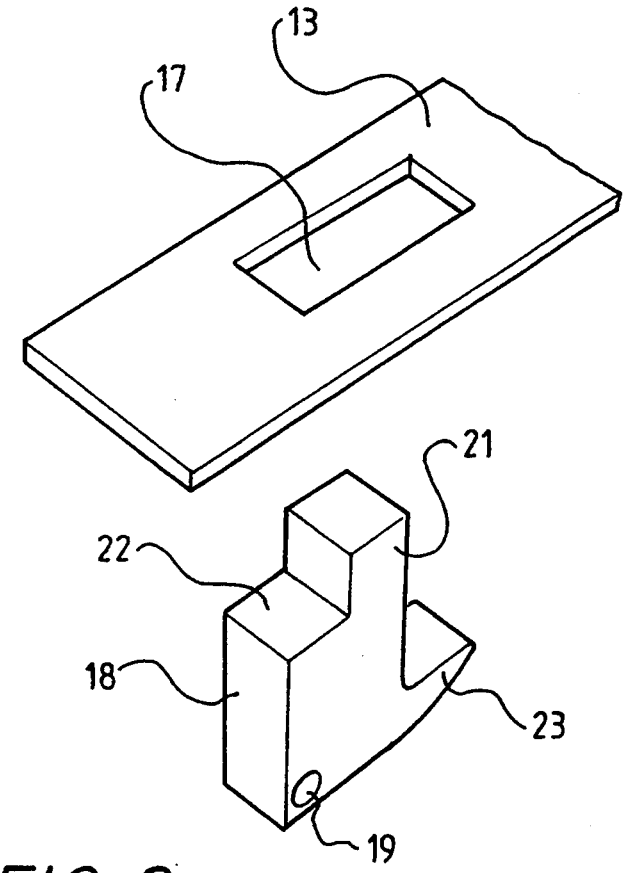
FIG. 2 is a view illustrating the toggle and associated spring in perspective.

The ejector spring element 12 is of "U" or "hair-pin" configuration and has a first substantially linear part 13, the end of which passes through the aperture 11, a curved portion 14 which extends around a locating pin 15, and a further linear portion 16 which extends parallel with the first linear part 13 but beneath that first part 13. An aperture 17 is formed in the first linear part, as can be seen in FIG. 2. A toggle 18 is associated with the aperture.

The toggle 18 comprises an element which is mounted pivotally to pivot about a pivot axis 19 and is spring biassed by means of a spring 20 to adopt a position in which the toggle is tilted to the left about the pivot axis 19 as shown in FIGS. 2 and 3. The toggle 18 has a projection 21 provided at its upper end adapted to pass through the aperture 17 and is also provided with a shoulder 22 adjacent the projection 21 which, in the initial condition of the toggle, is adapted to engage the under-surface of the linear portion 13 of the actuating spring 12 adjacent the aperture 17. It will be appreciated that with the toggle in the condition illustrated in FIG. 1, a region of the actuating spring 12 adjacent the aperture 17 in the linear part 13 engages the shoulder 22, and thus that part of the spring cannot move downwardly. The upper part of the toggle 18 is, however, dimensioned to pass through the aperture 17 when the toggle 18 is aligned with the aperture.

The toggle is provided with a projecting foot 23 which projects towards the right of the toggle adjacent the base of the toggle as shown in the accompanying drawings.

An actuating lever 24 is provided which is an elongate element having a first exposed actuating end portion 25 and a substantially centrally disposed pivot pin 26 which pivotally connects the actuating lever to the first component 2 which carries the anvil at a point substantially half-way between the pivot point 5 (between the first component 2 and the second component 4) and the anvil 3. The other end of the actuating lever 24 carries a roller 27 which engages the upper surface of the lower part 16 of the actuating spring 12.

It is to be observed that the length of the lower part 16 of the actuating spring 12 is such that if the lower part is moved downwardly the end of the lower part 16 of the actuating spring 12 will touch the foot 23 provided on the toggle 18.

A spring 28 is provided engaging the actuating lever 24 and a stop 29 provided at the rear end of the second component 2 to bias the actuating lever downwardly. This has the effect of keeping the device in the condition shown in FIG. 1 with the jaws open.

When the described device is to be utilised staples are located in the staple magazine and the staple pusher 7 will then, under the influence of the spring 8, bias the staples towawrds the ejection slot 9. A staple will therefore be present in the ejection slot 9 when the stapling machine is in the condition illustrated in FIG. 1 in which the staple ejector blade 10 is in an elevated condition.

The toggle 18 is tilted towards the left, as shown in the drawings, under the biassing effect of the spring 20, thus retaining the upper part of the actuating spring 12 in the upper position. A plurality of sheets of paper to be stapled together may be located between the component 2 carrying the anvil and the component 4, carrying the staple magazine and the staple ejector blade, and the rear part of the stapling machine (that is to say the part shown towards the right in FIG. 1) is grasped with the upper rear part of the upper component 4 being received in the palm of the hand, and with the fingers engaging the operating part 25 of the actuating lever 24. As initial pressure is applied to the actuating lever 24, the lever pivots about the roller 27 against the bias of the spring 28. This serves to cause the lower component 2 to pivot about the pivot axis 5, moving the real location of the pivot axis 26. This movement of the lower component continues until the sheets of paper located between the upper component 4 and the lower component 2 have been gripped. A subsequent application of pressure to the actuating lever 24 causes the lever to pivot about the pivot axis 26. The causes the roller 27 to move towards the left (as shown in FIG. 1) and downwardly. This causes the lower part 16 of the ejector spring 12 to move downwardly to the position shown in phantom in FIG. 1. This downwawrd movement of the lower portion of the spring 16 applies a significant force to the upper part of the spring tending to move the upper part of the spring downwardly. However, the upper part of the spring cannot move downwardly because of the action of the toggle 18.

When the lower part 16 of the spring 12 has moved downwardly by a certain extent, a significant force exists tending to bias the upper part 12 of the spring to move donwardly and then the end of the lower part of the spring engages the rearwardly extending foot 23 provided on the toggle 18. Further movement of the actuating lever 24 causes the toggle to pivot, in a clockwise sense, about the pivot axis 19, against the bias provided by the spring 20. When the toggle has pivotted, the shoulder 22 is aligned with the forward part of the aperture 17 and the upper part 13 of the actuator spring 12 can then move downwardly. The upper part of the toggle 18 thus passes through the aperture 17. The upper part of the actuator spring 12 is, of course, biassed downwardly with a significant force because the lower part 16 of the spring has been moved downwardly by the roller 27.

Thus, the upper part 13 of the actuator spring 12 does move downwardly, forcing the staple ejector blade 10 downwardly through the ejection slot 9, causing a staple to be ejected through the slot 9. The ends of the arms of the staple are passed through the sheets of paper engaged between the upper component 4 and the lower component 2, and are clinched by the anvil 3.

The actuating lever is then released. The spring 28 which engages the interior of the actuating arm 24 and a stop 29 forces the actuating lever back to the initial condition. As the lever moves in a clockwise sense about the pivot point 26 as shown in FIG. 1 the roller 27 engages the underside of the upper part 13 of the actuator spring 12. The entire spring thus rotates about the locating pin 15 until it returns to the initial positon of FIG. 1. The lower part of the spring thus also moves upwardly and under the influence of the biassing spring 20 the toggle returns to its initial condition. The described cycle of operation can then be repeated.

The prime advantage of a stapling machine as described above is that the staple is not ejected until the person actuating the machine has applied sufficient force to the actuating lever 24 to cause the above described chain of events to commence. Thus a predetermined amount of force has been stored in the stapling machine, because a predetermined deformation has been applied to the actuator spring 12. This force is selected to be sufficient to drive a staple through an appropriate number of sheets of paper. The device operates with an impulse or "click" so that the person operating the device is well aware of the fact that the device has operated to staple the sheets of paper together.

Referring to FIG. 3 a modified embodiment of the invention comprises a stapling machine 31 which incorporates a lower elongate component 32 in the form of an anvil carrier which carries, at its forward end, an anvil 33 to clinch the lower ends of staples. The anvil 33 is retained in position by an anvil retainig spring 34, the spring defining an aperture 35 which engages a spigot 36 carried by the anvil carrier 32. One end of the spring 34 retains the anvil and the other end of the spring defines an upwardly extending arch 37 which engages the undersurface of a magazine carrier 38. The magazine carrier is of channel-form. The side walls 39 of the magazine carrier terminate, at the forward end, with inwardly directed flanges 40 and the side walls of the magazine carrier define arcuate apertures 41. One side wall of the magazine carrier, as visible in FIG. 3 defines an aperture 42 which forms a "window". Contained within the magazine carrier 38 is a magazine 43 having side walls 44, the side walls terminating at the forward end with inwardly directed flanges 45. The magazine is adapted to receive a strip of staples. Slidably mounted within the magazine is a staple pusher 46 which is moulded integrally of plastic and which has an upstanding projection 47 adapted to engage a constant tension spring 48. The constant tension spring comprises two end portions 49 which each terminate with a spiral portion 50, these portions 49 being inter-connected by an intermediate piece 51. The intermediate piece 51 is adapted to engage the abutment 47 provided on the staple pusher 46. The spiral portions are adapted to engage a spring guide 52 which in turn is adapted to be received within an appropriate cavity formed in the under-surface of a staple steady 53. The staple steady is adapted to lie over staples present in the magazine. The staple steady 53 is provided with a lug 54 and the side walls of the magazine holder 38 are provided with lugs 55, the lugs 54 and 55 being adapted to engage trunions 56 provided for that purpose on the anvil holder 32.

The staple steady 53 defines an aperture 57 in its side wall adapted to be co-aligned with the aperture 42 in the side wall of a magazine holder 38.

A toggle 58 is provided having a bore 59 therethrough adapted to receive a pin which also passes through apertures 60 formed in upstanding wall portions provided on the top of the staple steady 53. The toggle is thus pivotally mounted in position. The toggle may be spring biased by means of an appropriate spring as in the manner of the toggle 18 described with reference to FIG. 1. The upper part of the toggle is provided with a projection 61 adapted to pass through an aperture 62 formed in the upper part 63 of a spring 64 of "U" or "hair-pin" configuration, the lower arms 65 of the spring being of lesser extent than the upper arm 63. The spring is adapted to be received on top of the staple steady 53.

A cover 66 is provided adapted to be mounted over the components described above, the cover 66 presenting a window or aperture 67 in the side thereof adapted to be coaligned with the apertures 42 and 57 described below. A release catch 68 is provided which is associated with a release catch clip 69 so that the release catch clip can be mounted on the front of the cover.

A staple ejector blade 70 is provided defining an aperture therein 71 which engages a projection 72 provided at the forward end of the upper arm 63 of the spring 64.

A carrier front plate 73 is provided adapted to be mounted on the carrier.

A lower actuating lever 74 is provided which has, substantially at its mid-point, a bearing 75 which is adapted to be received within a recess 76 provided at the mid-point of the anvil carrier 32. A roller 76 is provided at the forward end of the actuating lever 74, the roller passing through the arcuate slots 41 and engaging the upper surface and the lower part 65 of the spring 64.

It is to be appreciated that by actuating the catch 68 the magazine may be moved forwardly so it projects from the housing 66, enabling the supply of staples within the magazine to be replenished.

When the magazine is pushed back into the housing the staple ejector 47 will engage the portion 51 of the spring 48, and as the staple ejector is moved further towards the right as shown in FIG. 1 the spiral portions 51 of the spring will tend to unwind, thus placing the spring under tension and applying a bias to the staple ejector 46 tending to move the staple ejector towards the left, thus biasing staples towards the ejection slot.

In an initial condition the toggle 58 is in a forward position, with the projection 61 passing through the aperture 62 and the shoulder, adjacent the projection, engaging the upper arm 63 of the spring. When pressure is applied to the actuating lever 74 the anvil carrier will tend to move pivotally upwardly thus gripping any paper located between the anvil and the magazine holder, and also the lower part 65 of the spring will tend to move downwardly, due to the force applied thereto by the roller 76. When the lower end of the spring engages the projecting foot provided on the toggle, the toggle will be pivotted, enabling the upper part 63 of the spring to move downwardly under the bias applied thereto due to the tension present in the spring 64. The staple ejector blade will thus move downwardly swiftly, causing a staple to be elected.

The spring 48 may have markings present on the part thereof that forms the coil 50 adjacent the apertures 42 and 57 when the supply of staples is about to be exhausted. This marking will then be visible through a slit 52′ provided for that purpose in spring guide 52, the aperture or window 67 formed in the housing 66 to provide an indication that the supply of staples is about to be exhausted.

Whilst the invention has been described by way of example with reference to one embodiment it is to be appreciated that many modifications may be effected without departing from the scope of the invention as defined by the following claims. For example, whilst the invention has been described with reference to an embodiment in which there is a single window provided on one side of the main housing 31 to enable the stages of the supply of staples to be observed, in a modified embodiment two windows may be provided, one on each side of the housing. Thus the status of the supply of staples may be observed from either side of the housing.

What is claimed is:

1. A stapling machine for stapling together sheets of paper, said stapling machine comprising:

a first arm;

an anvil for clinching the ends of the arms of a staple, said anvil being integral with said first arm;

a second arm being pivotally connected to said first arm;

a magazine for carrying staples, said magazine being mounted on said second arm;

said second arm having a staple ejection slot adjacent said magazine;

means for biasing staples within said magazine towards said staple ejection slot;

a staple ejector blade for ejecting staples through said staple ejection slot towards said anvil, said staple ejector blade being mounted on said second arm adjacent said staple ejection slot;

an actuator element for moving said staple ejector blade relative to said second arm, said actuator element being operatively connected to said staple ejector blade; an actuator lever for applying a first predetermined force and a second predetermined force greater than said first predetermined force to said actuator element; and a toggle, said toggle being pivotally mounted on said second arm, said toggle having a shoulder, said shoulder being engaged with said actuator element during an application of said first predetermined force to retain said actuator element in a stationary position relative to said second arm, and said shoulder being disengaged from said actuator element during an application of said second predetermined force to allow said actuator element to move relative to said second arm.

2. The stapling machine of claim 1, further including means for resiliently biasing said shoulder into engagement with said actuator element.

3. A stapling machine for stapling together sheets of paper, said stapling machine comprising:

a first arm;

an anvil for clinching the ends of the arms of a staple, said anvil being integral with said first arm;

a second arm being pivotally connected to said first arm;

a magazine for carrying staples, said magazine being mounted on said second arm;

said second arm having a staple ejection slot;

means for biasing staples within said magazine towards said staple ejection slot;

a staple ejector blade for ejecting staples through said staple ejection slot towards said anvil, said staple ejector blade being mounted on said second arm adjacent said staple ejection slot;

an actuator element for moving said staple ejector blade, said actuator element being a "U" shaped spring having first and second substantially parallel legs, said first leg being operatively connected to said staple ejector blade, and said second leg providing means for transmitting a biasing force to said first leg;

an actuator lever for applying a first predetermined force and a second predetermined force greater than said first predetermined force to said actuator element; and a toggle being pivotally mounted on said second arm and having a shoulder and a projection, said shoulder being engaged with said first leg of said "U" shaped spring during an application of said first predetermined force and said second leg of said "U" shaped spring contacting said projection and pivoting said toggle and said shoulder out engagement with said first leg during an application of said second predetermined force.

4. The stapling machine of claim 3 wherein said actuating lever is pivotally connected to said first arm and engaging said actuator element.

5. The stapling machine of claim 4 wherein said actuating lever engages said actuator element through a roller mounted on said actuating lever and contacting said second leg of said "U" shaped spring.

6. The stapling machine of claim 5 further including resilient means for biasing said actuating lever to an initial position, wherein said roller contacts said first leg of said "U" shaped spring at said initial position.

* * * * *

US005335838C1

(12) EX PARTE REEXAMINATION CERTIFICATE (9062nd)

United States Patent
Harris et al.

(10) Number: US 5,335,838 C1
(45) Certificate Issued: Jun. 12, 2012

(54) STAPLING MACHINE

(75) Inventors: Edward M. Harris, Pontyclun (GB); Michael Burlington, Mark Cros (GB)

(73) Assignee: ACCO Brands Corporation, Lincolnshire, IL (US)

Reexamination Request:
No. 90/011,204, Sep. 2, 2010

Reexamination Certificate for:

| | |
|---|---|
| Patent No.: | **5,335,838** |
| Issued: | **Aug. 9, 1994** |
| Appl. No.: | **07/976,342** |
| Filed: | **Nov. 17, 1992** |

(30) Foreign Application Priority Data

Nov. 19, 1991 (GB) ..... 9124499.6

(51) Int. Cl.
*B25C 5/02* (2006.01)

(52) U.S. Cl. ..... 227/132; 227/134; 227/144

(58) Field of Classification Search ..... 227/132
See application file for complete search history.

(56) References Cited

To view the complete listing of prior art documents cited during the proceeding for Reexamination Control Number 90/011,204, please refer to the USPTO's public Patent Application Information Retrieval (PAIR) system under the Display References tab.

*Primary Examiner*—Aaron J. Lewis

(57) ABSTRACT

In a stapling machine, an ejector blade can be moved to eject a staple through a staple ejection slot towards an anvil adapted to clinch the ends of the arms of the staple. The staple ejector blade is moved by an actuator element. A toggle is provided which maintains the actuator element in a first position until a predetermined force has been applied to the actuator element. The toggle then releases the actuator element permitting the actuator element to move the ejector blade to eject a staple through the staple ejection slot towards the anvil.

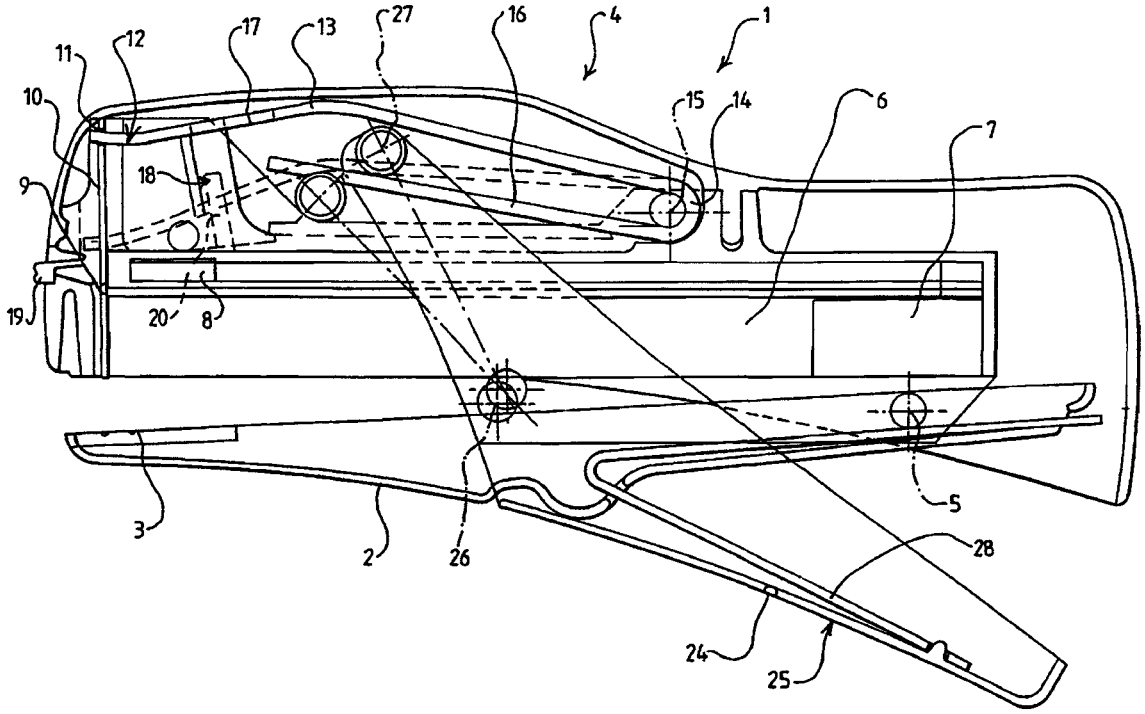

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 3-6 is confirmed.

Claims 1 and 2 are cancelled.

* * * * *